United States Patent [19]

Kirby et al.

[11] Patent Number: 5,044,017

[45] Date of Patent: Sep. 3, 1991

[54] HELMET RETAINERS OPERATED BY ROTARY HANDLES

[76] Inventors: Robert R. Kirby, P.O. Box 665; William S. Millard, 2866 Santa Barbara Ave., both of Santa Ynez, Calif. 93460

[21] Appl. No.: 522,911

[22] Filed: May 14, 1990

[51] Int. Cl.[5] ..... A42B 7/00

[52] U.S. Cl. ..... 2/421; 2/2.1 R; 2/2.1 A

[58] Field of Search ..... 2/421, 2.1 R, 2.1 A, 2/6

[56] References Cited

U.S. PATENT DOCUMENTS

| | | | |
|---|---|---|---|
| 3,353,534 | 11/1967 | Savoie, Jr. | 2/2.1 R |
| 3,534,408 | 10/1970 | Fifield | 2/2.1 R |
| 3,574,862 | 4/1971 | Jones | 2/2.1 R |
| 3,584,313 | 6/1971 | Brown et al. | 2/2.1 R |
| 3,958,175 | 5/1976 | Morgan et al. | 2/2.1 R |
| 4,015,294 | 4/1977 | O'Neill | 2/2.1 R |
| 4,034,416 | 7/1977 | Buffkin et al. | 2/2.1 R |
| 4,290,150 | 9/1981 | Guerre-Berthelot | 2/421 |

*Primary Examiner*—Werner H. Schroeder
*Assistant Examiner*—Michael A. Neas
*Attorney, Agent, or Firm*—Harry W. Brelsford

[57] ABSTRACT

A diver's helmet is retained on the diver's skull by curved retainer rods hinged to each side of the helmet. Connected to the hinged rods are rotary handles operated by the diver to rotate the rods under the jaw and base of the skull to retain the helmet, and rotated away from the diver's head to permit doffing and donning of the helmet. The retainer can be combined with a neck dam to clamp the elastic dam against the diver's jaw and skull to prevent ballooning of the neck dam and thereby prevent a change in buoyancy. When the retainer rods are hinged to helmet they act to retain the neck dam to the helmet.

11 Claims, 5 Drawing Sheets

HELMET RETAINERS OPERATED BY ROTARY HANDLES

This invention relates to rigid diver's helmets and has particular reference to a manually operable mechanism for retaining a rigid diver's helmet on the diver's head.

BACKGROUND ON THE INVENTION

Most diving helmets are rigid and waterproof and are connected to the diver's body or a diver's suit by a flexible tubular member known as a neck dam. The neck dam acts as the flexible waterproof connector between the rigid helmet and the diver's body or suit. In some cases, particularly with wet suits, the neck dam seals directly to the diver's neck. The tubular dam is connected by a water tight joint to the bottom edge of the rigid diver's helmet.

The usual breathing regulator maintains the breathing gas pressure within the diver's suit and helmet at the same pressure as the water depth at which the diver is working. When a diver is standing upright the neck dam maintains itself generally close to the diver's neck. However, when a diver leans forward the internal air pressure causes the dam to bulge outwardly. This increases the buoyancy of the neck dam-helmet combination and the helmet moves upwardly with respect to the diver's head, moving the helmet to an awkward position.

To counteract this added buoyancy, helmets have been made heavier. Also, attempts have been made to hold the neck dam against expansion, but these attempts have interfered with, the free motion of the helmet as the diver rotates his head.

BRIEF SUMMARY OF THE INVENTION

This invention provides structure for holding a diver's helmet securely to the diver's head. Two generally crescent shaped gripper bars are disposed one under each side of the diver's jaw. These bars are hinged to rotate them away from the jaw of the diver when helmet retention is not desired as during donning and doffing. The hinged retainer bars are mounted on the outside of the helmet and are moved against the flexible neck dam to engage the under sides of the user's jaw. The bars are rotated on their hinges by a crank arm which in turn is rotated by an external handle. These handles may be tied together to form a bail that actuates both retainer bars simultaneously, or the handles may be independent. The retainer bars serve the dual function of retaining the helmet on the diver's head and holding the neck dam from ballooning outwardly. The mechanism serves a third function of a redundant latching system to hold the neck ring against the helmet to prevent them coming apart. The diver, however, has no restraints on his head movements because the other portions of the neck dam permit free movement of the helmet.

BRIEF DESCRIPTION OF THE DRAWINGS

In the drawings forming an integral part of this specification.

DETAILED DESCRIPTION

Figure 1:
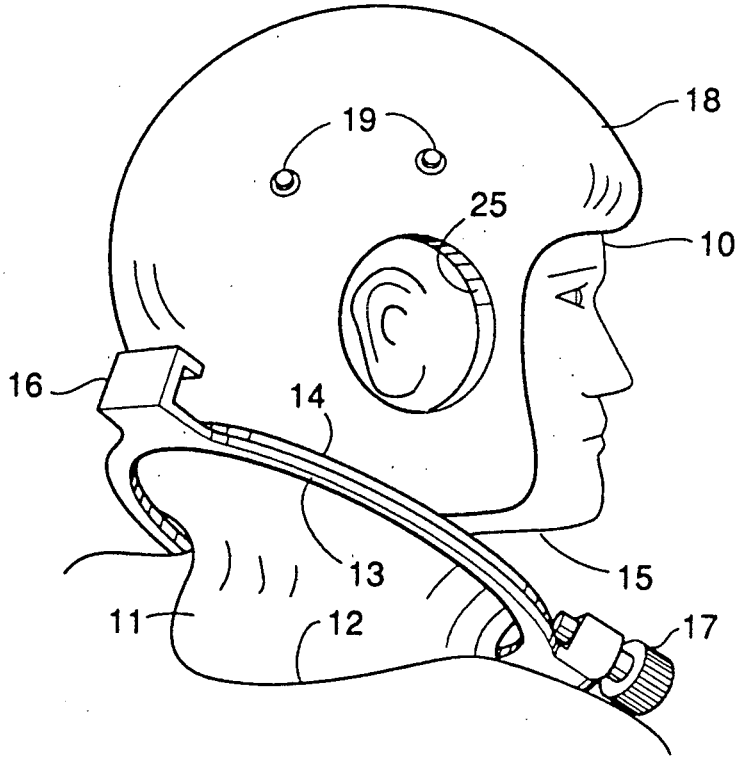
Fig. 1 PRIOR ART
FIG. 1 is a three dimensional view of a diver wearing a helmet cushion about his head having a neck dam disposed around his neck and having an integral connector ring.

Referring to FIG. 1 a diver 10 having a jaw 15 has placed over his head and resting on his shoulders a neck dam 11 of resilient and elastic material having a free lower edge 12 and an upper edge clamped between a pair of rings 13 and 14. Secured to the ring 13 is a rear catch 16 and a front spring pin 17 for locking a diver's helmet to the rings 13 and 14. This structure is conventional. Also illustrated in FIG. 1 is a helmet liner 18 with snaps 19 to hold it to the interior of the diver's helmet and a cutout 25 for ear phones. This also is conventional.

Figure 2:
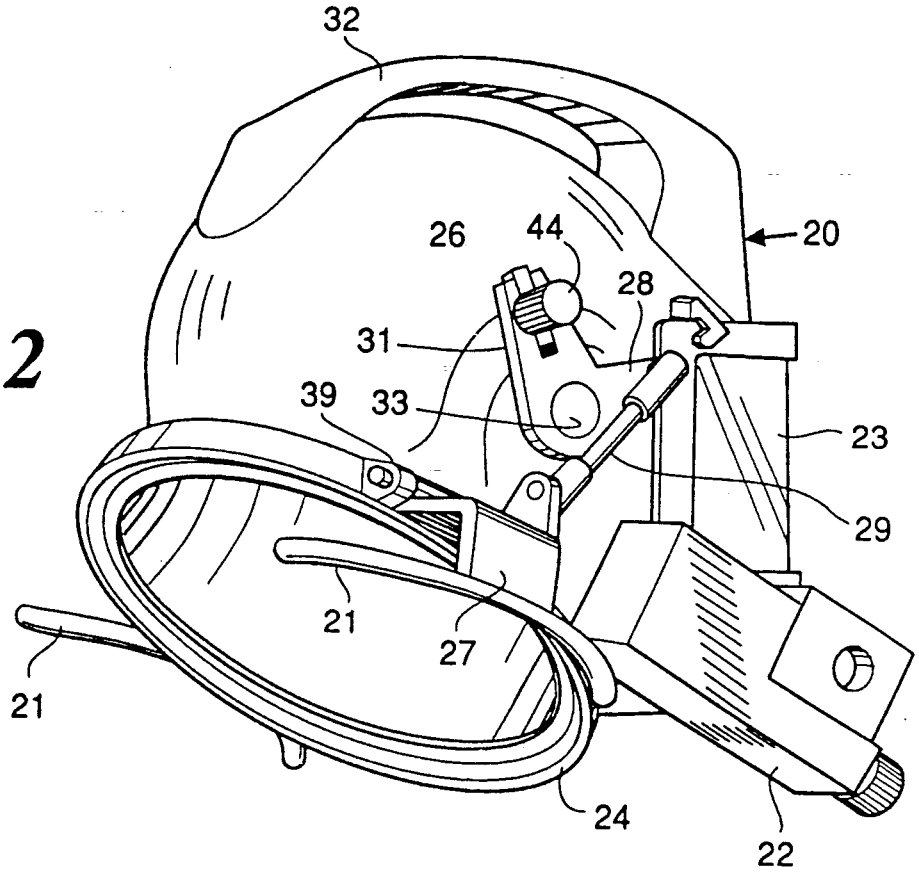
FIG. 2 is a three dimensional view of a diver's helmet having retaining bars embodying the invention, moved to the open position for placing the helmet over the diver's head and permitting connection to the connector ring of FIG. 1.

Illustrated in FIG. 2 is a diver's helmet 20 having a pair of gripper bars 21 embodying the invention. The helmet 20 is preferably of the rigid shell conventional type having the usual pressure regulator mechanism 22 and window 23. The helmet 20 has a bottom ring or breech ring 24 that retains a seal (not shown) to engage the rings 13–14 of FIG. 3. The helmet 20 is held onto the rings 13–14 of FIG. 1 by the catch 16 and spring pin 17 to establish a water tight seal.

Referring to FIG. 2 the helmet has a diver's right side 26 as viewed in FIG. 2, with an identical assembly on the left side which is not visible in FIG. 2. The right side 26 and left side each have a hinge having one hinge part secured to the helmet and having the movable part 27 of each hinge secured to the gripper bars 21. The moveable part 27 of each hinge is rotated on its hinge axis by a crank arm 28 and connecting rod 29. The crank arm 28 in turn is rotated by a handle or lever 31 which rotates on an axis transverse to the right side and left side of the helmet 20. Disposed at the top of the helmet 20 is a fore and aft helmet handle 32.

The helmet of FIG. 2 is shown with the gripper bars 21 revolved to an outward position so that the helmet liner 18 (FIG. 1) can be inserted in the helmet and the helmet donned or placed over the head of the diver 10 of FIG. 1.

Figure 3:
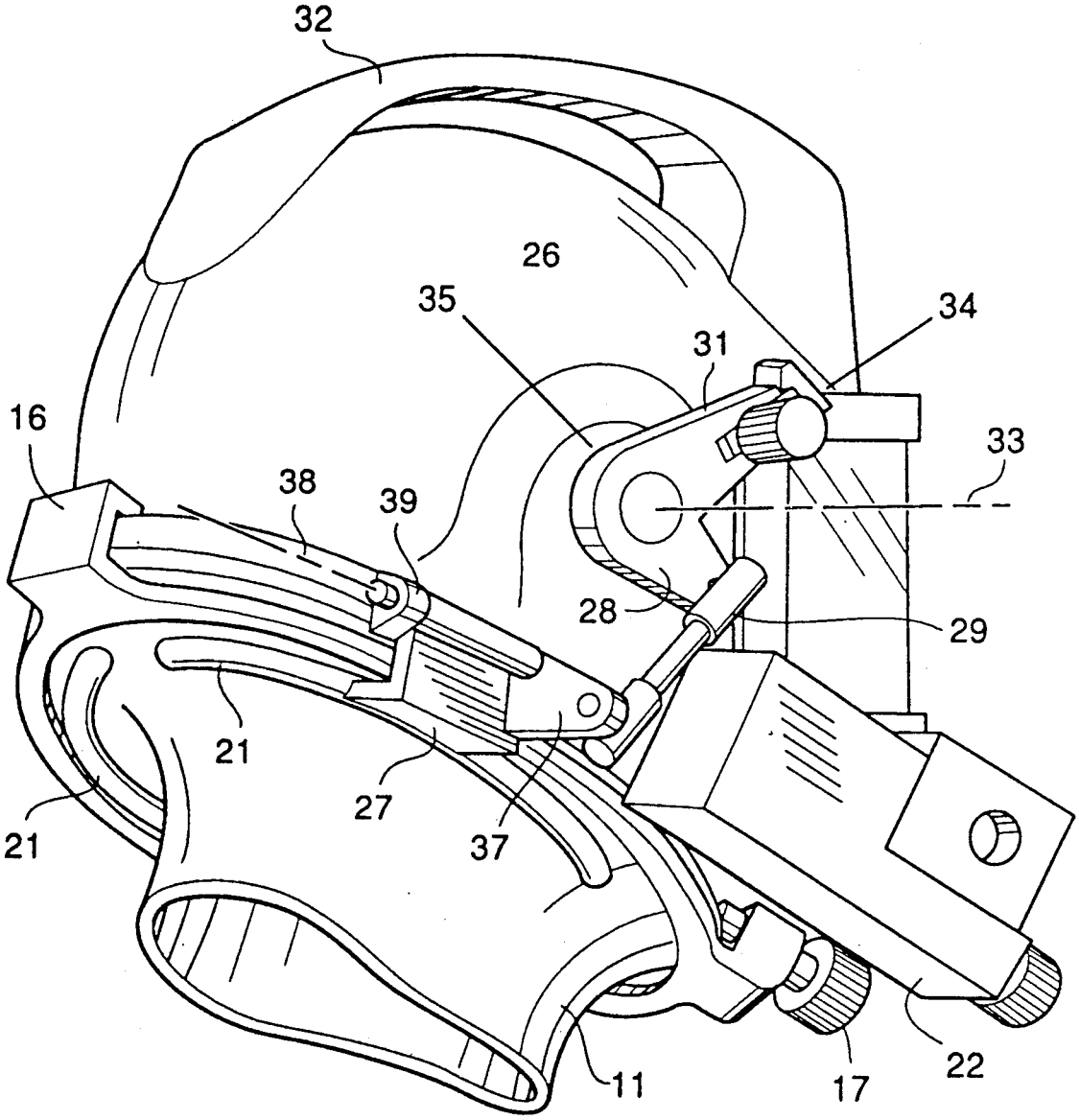
FIG. 3 is a three dimensional view on an enlarged scale of the helmet of FIG. 2 connected to the neck dam of FIG. 1, as viewed from a rear side and showing the retaining bars or gripper bars in place under the diver's jaw to retain the helmet tightly on the diver's head.

Illustrated in FIG. 3 is the helmet 20 as placed over the head 10 of a diver and with the gripper bars 21 revolved to bear against the neck dam 11. The dam in turn bears against the jaw 15 (FIG. 1) of the diver 10 and to a lesser extent bears against the lower part of the diver's skull. The gripper bars 21 preferably have a sufficient fore and aft dimension to substantially engage the dam 11 as shown in FIG. 3 but with a gap front and rear. The right side of the helmet is shown at 26 and the handle 31 rotates on its transverse axis 33 through an angle designated by the lines 34 and 35. When the handle 31 is aligned with the line 34 the gripper bars 21 hold the helmet tightly to the diver's head as illustrated in FIG. 3. When the handle 31 is manually rotated to the line 35 the gripper bars 21 are rotated to the open position shown in FIG. 2.

Referring still to FIG. 3, the crank arm 28 is secured to the handle 31 to rotate when the handle is rotated. The lower end of the connecting rod 29 engages a projection 37 on the moveable hinge part 27, to cause the hinge part 27 to rotate on a fore and aft hinge axis 38. Each hinge has a stationary part 39 secured to the helmet and part 27 is the moveable part of the hinge.

Figure 4:
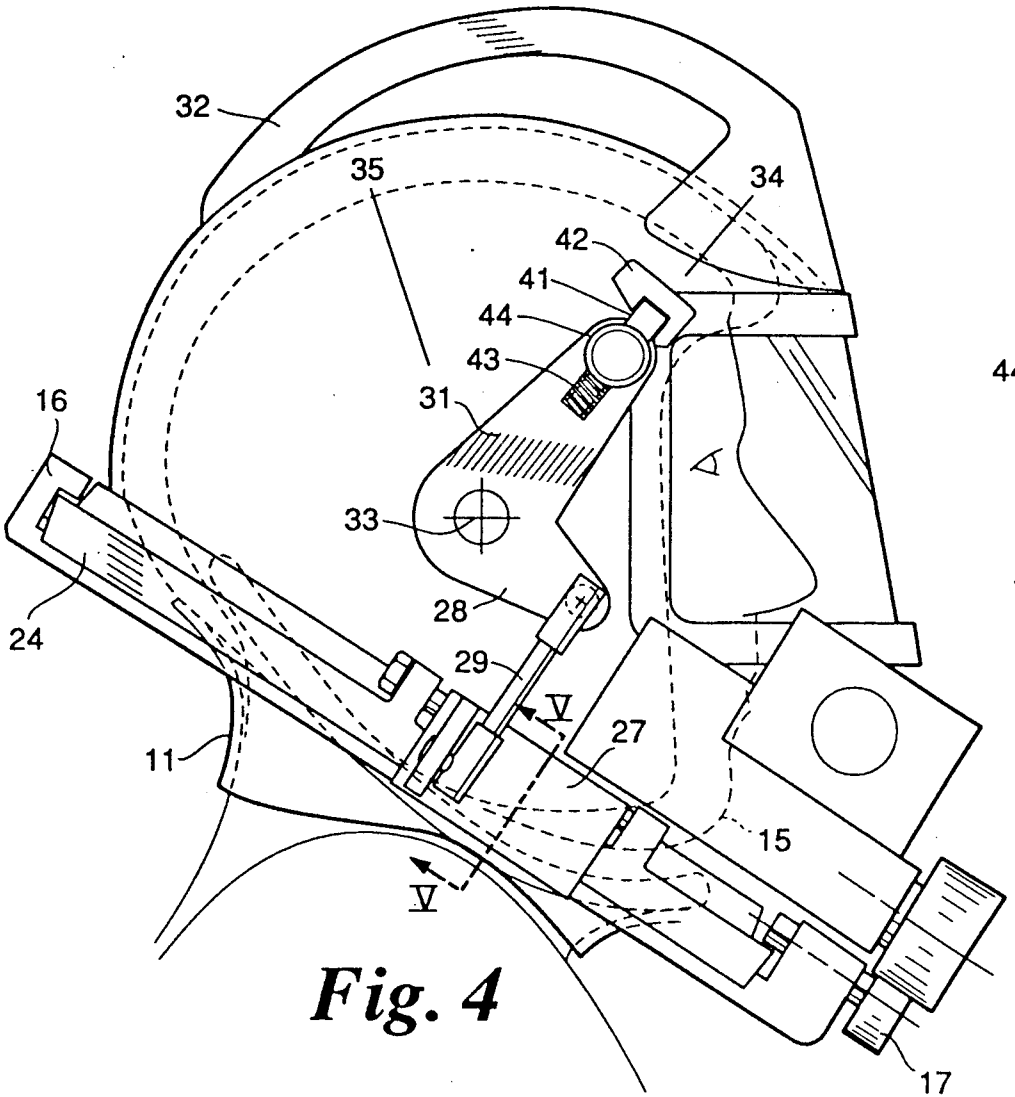
FIG. 4 is a side view of the helmet of FIG. 3 showing a latch mechanism for the manually operable handle and showing the retainer bars gripping the diver's head.

Referring to FIG. 4, disposed on the upper end of each handle 31 is a latch pin 41 urged upwardly by a compression spring 43. Projecting from the helmet 20 is a notched boss 42. This latch pin 41 holds the handle 31 in the gripper activated position so that accidental blows against the bail will not interfere with the gripper action. When it is desired to move the gripper bars 21 to an open position as shown in FIG. 2, the diver manually pulls the latch pin by knob 41 with one hand while rotating the handle 31 to its rearward position along axis 33.

Figure 5:
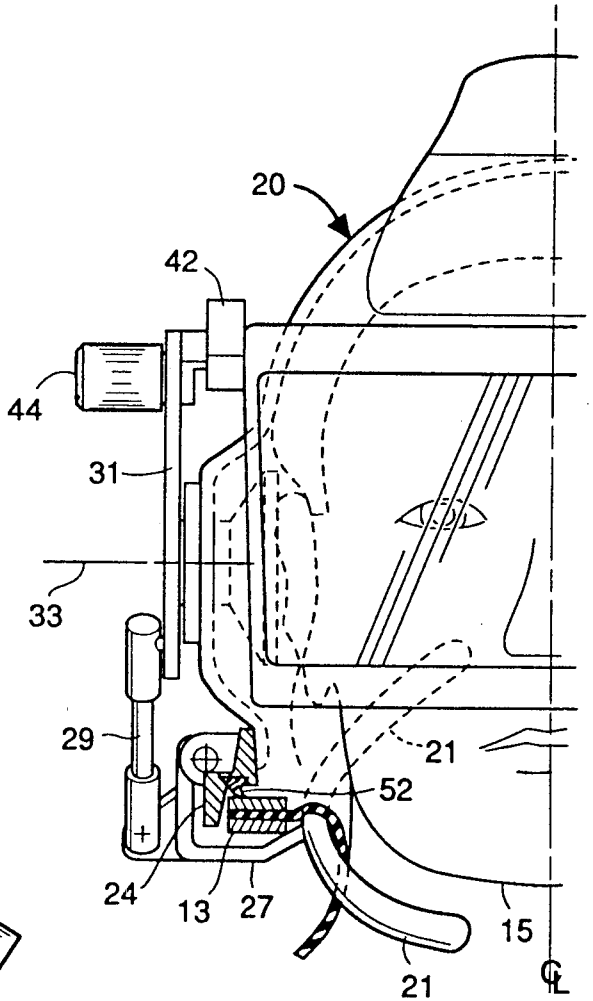
FIG. 5 is a partial front view of the helmet of FIG. 4 with parts in section along the line V—V of FIG. 4.

Referring to FIGS. 4 and 5, it will be noted that the forward part of the retainer rods 21 underlie the diver's jaw 15 and that the rear portion of the retainer rods 21 underlie the base of the skull of the diver. The neck dam 11, and any desired cushioning material, is forced against these head portions to hold the helmet 20 to the diver's head 10. The hinge 27 also engages the neck dam ring 13 to additionally lock the helmet 2 to the neck dam 11.

Shown in FIG. 4 is the usual mechanism for holding the neck dam 11 to the helmet 20. The helmet ring 24 engages the rear catch 16 and the front spring pin 17 engages the forward part of helmet ring) 24.

Shown in FIG. 5 is the structure for sealing the helmet to the neck dam. Disposed in a dovetail groove in the helmet ring 24 is an elastic and flexible seal or gasket 52 which is pressed against neck dam ring 14.

Figure 7:
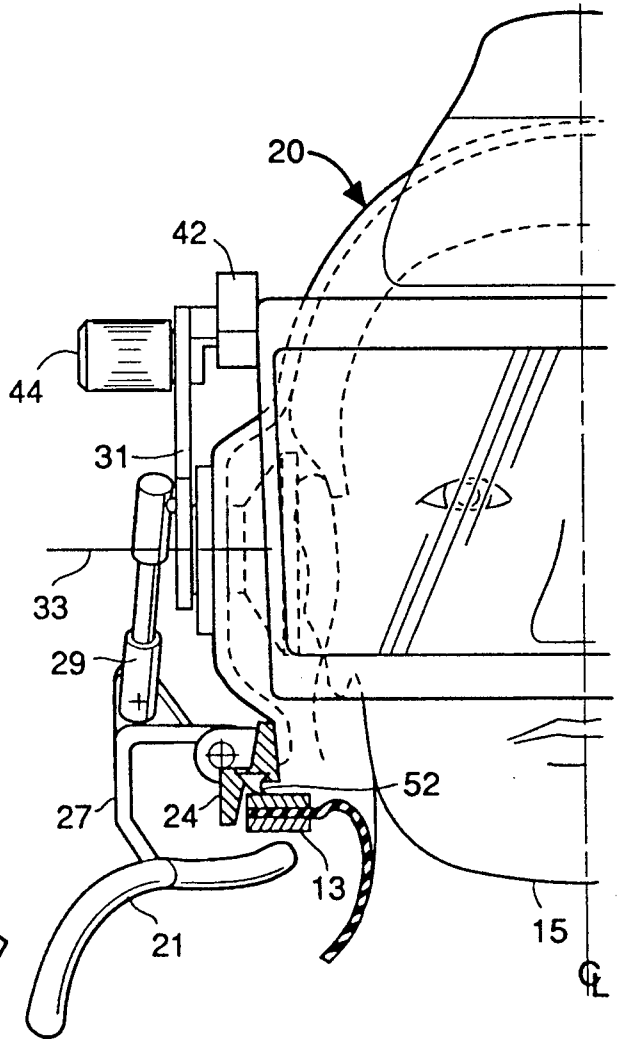
FIG. 7 is a partial front view of the helmet of FIG. 6 with points in section along the line VII—VII of FIG. 6.
Figure 6:
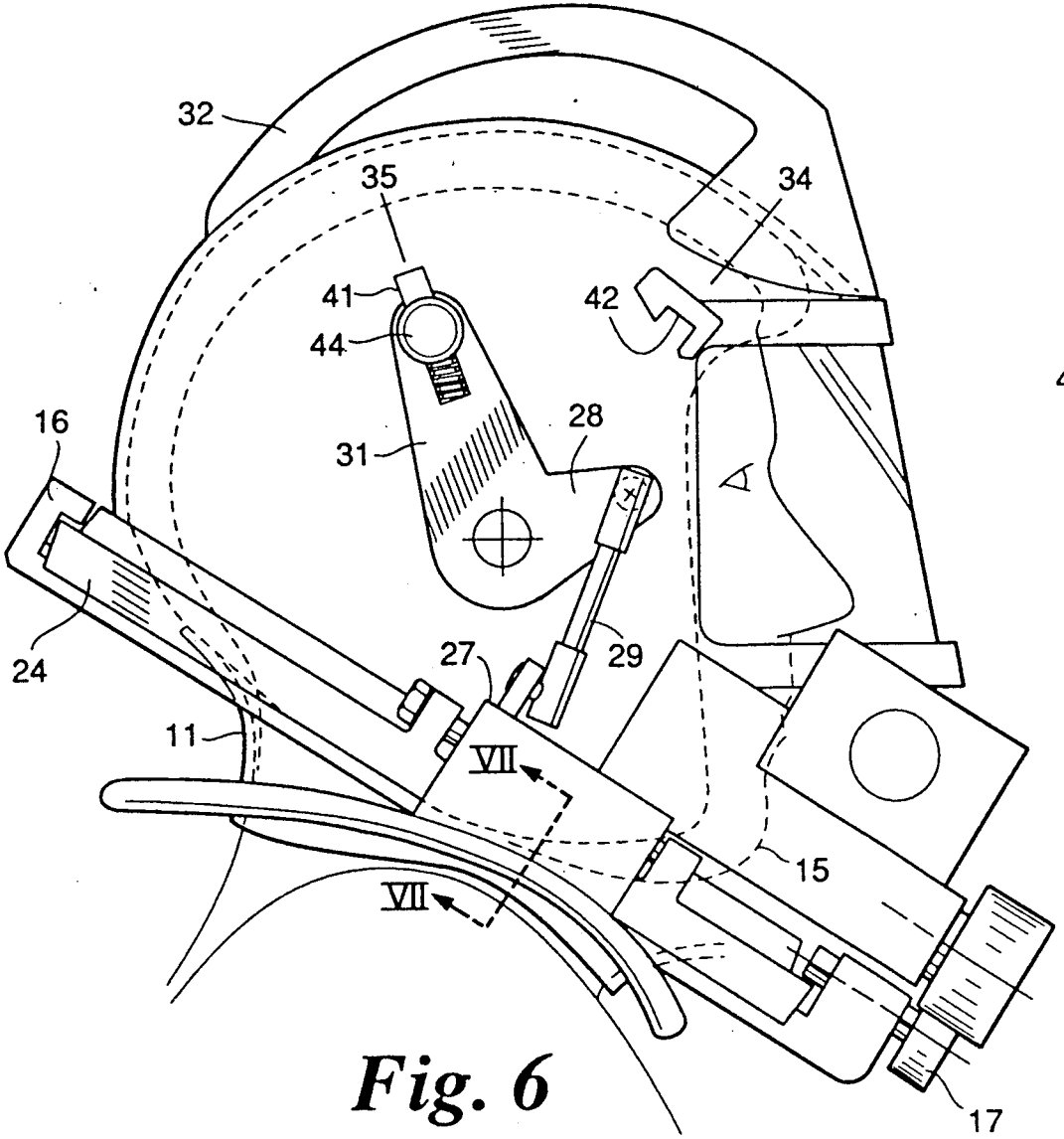
FIG. 6 is a side view of the helmet of FIG. 4 with the gripper bars rotated to the open position as shown in FIG. 2.

Referring to FIGS. 6.and 7, the gripper rods and the operating mechanism are shown in the open position. The diver has manually grasped knob 44 and pulled it downward to release pin 41 from notch 42 and has manually rotated the handle 31 counterclockwise as viewed in FIG. 6. This caused the crank arm 28 to rotate counterclockwise, pulling on connecting rod 29 to rotate hinge 27 to its outward position. This in turn revolves the retainer rods toward the outside of the helmet 20, thus making it possible to remove or doff the helmet. This is done by pulling outwardly on spring pin 17 which then permits the forward separation of the neck dam rings 13 and 14 from the helmet ring 24. Further rotation of these two rings releases ring 24 from catch 16. The helmet can then be doffed. In an emergency the helmet and neck dam can be doffed as a unit when these gripper rods are rotated to the open position shown in FIGS. 6 and 7.

Figure 8:
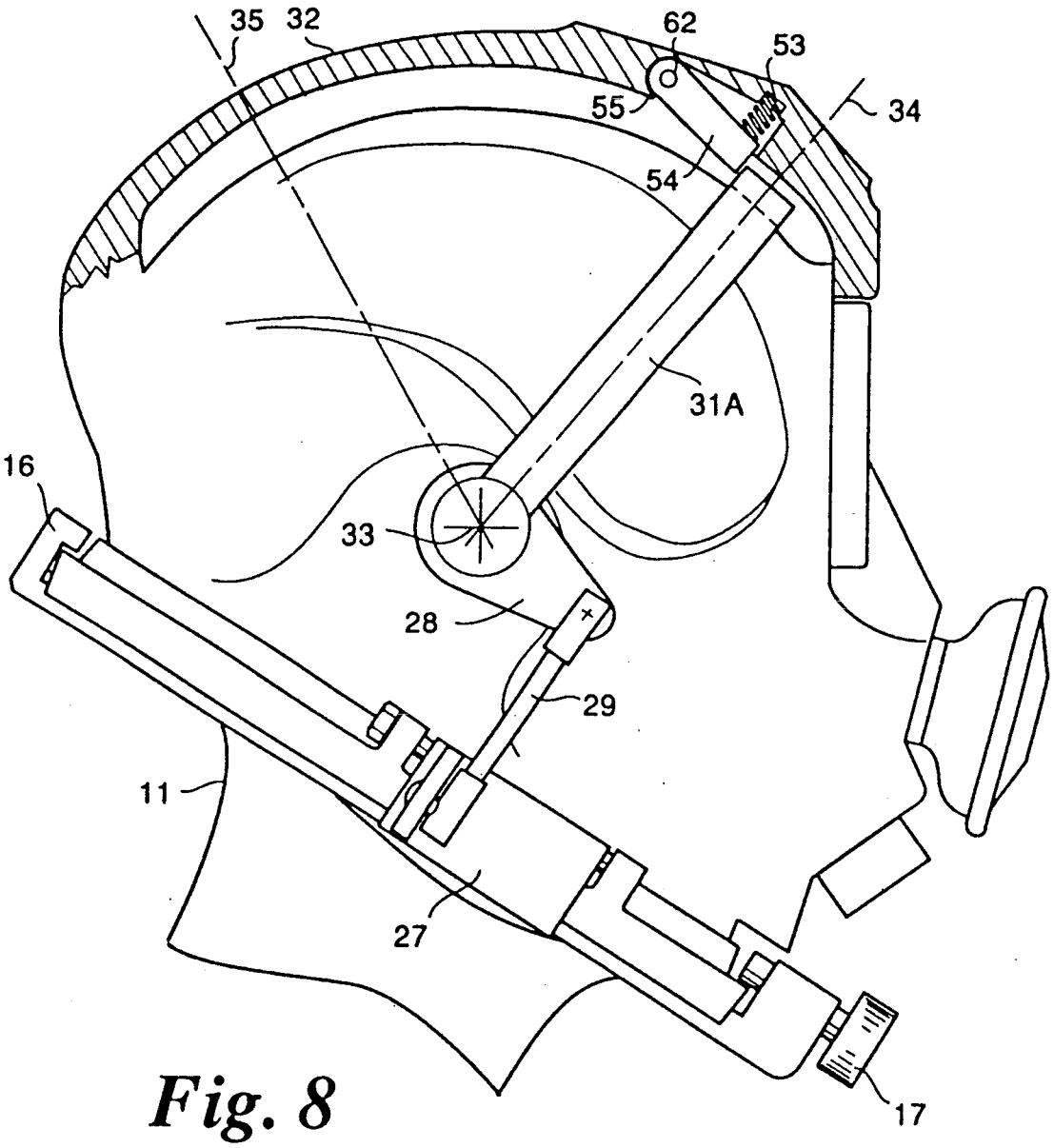
FIG. 8 is a side view, partly in section showing a modified form of the invention wherein both gripper bars are operated simultaneously by a bail.

Shown in FIG. 8 is a modified form of the invention wherein both gripper rods 21 are revolved simultaneously. This is done by substituting a bail 31A for the handles 31 of FIGS. 2-7. Rotation of the bail 31A results in simultaneous rotation of crank arms 28 to revolve the gripper rods 21. Any suitable latch mechanism can be employed to lock the gripper rods 21 against the skull of the diver. Formed in the helmet handle 32 is a lever 54 pivoted by a pin 62 and urged downward by a compression spring 53. A stop 54 limits the rotation of lever 54.

OPERATION OF FIGS. 1-7

The diver places the neck dam 11 of FIG. 1 over his head together with its integral rings 13 and 14 as shown in FIG. 1. The elastic and flexible dam 11 makes a watertight closure on the diver's neck. The helmet of FIG. 2 is next lowered or donned over the diver's head and is rotated at a slight angle to catch the helmet ring 24 in the rear catch 16 on the neck dam ring 13. The diver pulls outward on the spring pin 17, and, when the helmet ring 24 and dam ring 14 are mated, the spring pin 17 is released, locking the two rings together.

During the donning operation, both handles are rotated to the rear or counterclockwise position. This positions the gripper bars 21 out of the bottom area of the helmet and on the outside of the flexible neck dam 11. The diver next rotates both handles 31 clockwise until the latch pins 41 snap into the helmet notch 42 as shown in FIG. 4. This rotation of the handles 31 rotates crank arms 28 which push on connecting rods 29 to rotate hinge 27, revolving the rods 21 against the neck dam as shown in FIGS. 3 and 5. The movement of the gripper rods 21 presses the dam 11 under the jaw 15 of the diver and against the base of his skull, securely fastening the helmet to the diver's head.

The usual helmet regulator maintains the air inside the helmet and the neck dam 11 at the same pressure as the water pressure. If now the diver leans over, there is no bulging of the neck dam because it is held from bubbling or expansion by the gripper rods. The buoyancy of the helmet dam remains constant, and the diver can work without fear of a change in buoyancy. This in turn permits the helmets to be made in a lightweight construction because there is no requirement of weight to counteract an increase in buoyancy. The present structure serves the dual functions of retaining the helmet and preventing buoyancy changes.

Referring to FIGS. 1 and 3, it will be appreciated that an accidental pull on the spring pin of latch 17 may release the helmet 20 from the neck ring 13-14. This might occur for example when the diver is working in structures with very close spacings. The hinge and gripper bars of this disclosure act as a secondary latching or locking mechanism to hold the helmet 20 to the ring 13-14 as shown in FIG. 5 wherein the hinge part 27 may directly engage ring 13 to positively lock the helmet 20 to the neck ring 13-14. This is accommodated by the general "L" shaped cross section of the hinge members 27.

It will be appreciated that the handles 31 and associated crank arms 28 can be rotated about any axis, for example on front-rear axis. However, the transverse axis keeps the mechanism close to the helmet and therefore minimizes helmet contact when the diver is working in close quarters.

Further, it will be appreciated by those skilled in the art that the retainer mechanism can be located on the neck dam. However, it is desirable to reduce the weight of the neck dam because divers frequently wait for hours with the helmet off but with the neck dam in place.

This invention has been described with reference to the presently preferred embodiments as required by the patent statutes. Various alterations, improvements, and modifications will be apparent to those skilled in the art. All such alterations, modifications, and variation that come within the true spirit and scope of the invention are included within the scope of the claims.

We claim:

1. In combination with a rigid diver's helmet disposable over the head and jaw of a user and having a right side and left side and an axis transverse to the two sides, a helmet retainer comprising:
   (a) a pair of hinges having a movable hinge part, a first movable hinge part mounted on the left side of the helmet and a second movable hinge part mounted on the right side of the helmet;
   (b) a gripper bar secured to the movable part of each of the hinges;
   (c) a handle secured to the outside of the helmet for rotation;
   (d) and means for connecting the handle to at least one of the movable hinge parts for revolving at least one of the gripper bars under at least one side of the user's jaw when the handle is rotated to retain the helmet on the diver's head.

2. The combination of claim 1 wherein a crank and connecting rod interconnect the handle and the movable hinge parts.

3. The combination of claim 1 wherein the handle rotates on the transverse axis.

4. A helmet retainer for a diver's helmet disposable over the head and jaw of a user and having a right side and left side and an axis transverse to the two sides, comprising:
   (a) hinges having a rotatable part hinged on the left and on the right side of the helmet;
   (b) a gripper bar secured to each rotatable hinge part and revolvable to a position under the jaw of the user;
   (c) a handle secured to each side of the helmet for rotation about said transverse axis;
   (d) and means for connecting each handle to the rotatable hinge parts for revolving the gripper bars under the user's jaw and away from the user's jaw when the handle is rotated.

5. A helmet retainer as set forth in claim 4 wherein a crank arm is connected to a handle on each side of the helmet and a connecting rod connects each crank arm and each rotatable hinge part.

6. The combination of a helmet disposable over the skull and jaw of a user and having a front, a back, a bottom edge and sides, a neck dam connected to the bottom edge of the helmet, and a helmet retainer, said helmet retainer comprising:
   (a) a pair of hinges hinged one on each side of the helmet adjacent to the bottom edge;
   (b) a gripper bar secured to each hinge and having front and back extent sufficient to underlie at least one of the jaw and base of the skull of the user;
   (c) a handle secured to the outside of the helmet for rotation;
   (d) and means for connecting the handle to at least one of the hinges for revolving the gripper bars, one under each side of the user's jaw and skull base, to thereby hold the neck dam against the user's head and thereby prevent ballooning of the neck dam.

7. A diver's helmet comprising:
   (a) a rigid waterproof shell having a right side and left side, an axis transverse to the two sides and a bottom edge;
   (b) two hinges connected one to the left side and one to the right side of the shell adjacent to the bottom edge of the shell;
   (c) a gripper bar secured to each hinge;
   (d) a handle mounted on each side of the shell for rotation to rotatable positions;
   (e) and means for connecting the hinges to the handles for revolving the gripper bars under the bottom edge of the shell to a position under the user's jaw to thereby retain the shell on the user's hand; and
   (f) a latch interconnecting the handles and the helmet shell to hold the handles in at least one rotatable position.

8. In a combination of a helmet disposable over the head of a user and having a right side and left side and a bottom edge, and a neck dam having a neck ring on an upper edge thereof shaped to engage the bottom edge of the helmet, locking means for holding the neck ring to the helmet comprising:
   (a) hinges having a generally horizontal hinge axis and mounted one on each side of the helmet and having a movable outer hinge part having a generally L-shaped cross section;
   (b) means for rotating the outer hinge parts underneath the neck dam ring, and
   (c) means for latching the L-shaped hinge parts in position underneath the neck ring.

9. In combination with a rigid diver's helmet disposable over the head and jaw of a user and having a right side and left side and an axis transverse to the two sides, a helmet retainer comprising:
   (a) a pair of hinges having a movable hinge part, a first movable hinge part secured to the left side of the helmet and a second movable hinge part secured to the right side of the helmet;
   (b) a gripper bar secured to the movable part of each of the hinges;
   (c) a bail secured to the outside of the helmet for rotation about said transverse axis;
   (d) and means for connecting the bail to the movable hinge parts for revolving the gripper bars, one under each side of the user's jaw when the bail is rotated about its transverse axis to retain the helmet on the diver's head.

10. The combination of claim 9 wherein the helmet has a latch to hold the bail in at least one extreme of rotation.

11. A combination of a helmet disposable over the head of a user, a neck dam including a neck dam ring, and a helmet retainer, said helmet retainer comprising:
   (a) at least one hinge mounted on the helmet;
   (b) a retainer bar secured to the hinge;
   (c) a movable handle mounted the helmet;
   (d) and means for connecting the handle to the hinge, to revolve the retainer bar against the head of the user to retain the helmet.

* * * * *